US010325423B1

(12) United States Patent
Mannan et al.

(10) Patent No.: US 10,325,423 B1
(45) Date of Patent: Jun. 18, 2019

(54) METHOD AND SYSTEM FOR VALIDATING STATES OF COMPONENTS OF VEHICLE

(71) Applicant: ANI TECHNOLOGIES PRIVATE LIMITED, Bengaluru, Karnataka (IN)

(72) Inventors: Azimul Mannan, Karnataka (IN); Moiaz Jiwani, Chattisgarh (IN)

(73) Assignee: ANI TECHNOLOGIES PRIVATE LIMITED, Bengaluru, Karnataka (IN)

( * ) Notice: Subject to any disclaimer, the term of this patent is extended or adjusted under 35 U.S.C. 154(b) by 0 days.

(21) Appl. No.: 15/916,553

(22) Filed: Mar. 9, 2018

(30) Foreign Application Priority Data

Dec. 20, 2017 (IN) ..... 201741045863

(51) Int. Cl.
*G07C 5/00* (2006.01)
*G07C 5/08* (2006.01)

(52) U.S. Cl.
CPC ..... *G07C 5/0816* (2013.01); *G07C 5/006* (2013.01); *G07C 5/008* (2013.01); *G07C 5/0808* (2013.01)

(58) Field of Classification Search
None
See application file for complete search history.

(56) References Cited

U.S. PATENT DOCUMENTS 6,038,496 A * 3/2000 Dobler ..... B60T 7/22 250/559.06
6,492,944 B1 * 12/2002 Stilp ..... G01S 5/021 342/387
6,646,604 B2 * 11/2003 Anderson ..... G01S 5/02 342/465
8,344,850 B2 * 1/2013 Girard, III ..... H04L 63/102 307/10.2
9,417,078 B1 * 8/2016 Seibert ..... G07C 5/0858
9,545,930 B2 * 1/2017 Ricci ..... G01C 21/3484
10,001,565 B2 * 6/2018 Hwu ..... G01S 19/03
10,156,848 B1 * 12/2018 Konrardy ..... G05D 1/0088
10,223,380 B2 * 3/2019 Giurgiu ..... G06F 16/2365
10,223,479 B1 * 3/2019 Konrardy ..... H04W 4/90
10,223,608 B2 * 3/2019 Aoyama ..... G06T 7/97
2011/0184745 A1 * 7/2011 Brennan ..... G06Q 10/06 705/1.1
2015/0262108 A1 * 9/2015 Yen ..... G06Q 50/00 705/7.41
2016/0117871 A1 * 4/2016 McClellan ..... G01S 5/0027 701/31.5

(Continued)

*Primary Examiner* — Fekadeselassie Girma
(74) *Attorney, Agent, or Firm* — Goldberg Segalla LLP

(57) ABSTRACT

A system and a method for validating states of one or more components of a vehicle are provided. The system includes circuitry that receives an event, determines associated priority level based on first mapping. The circuitry identifies the one or more components associated with the priority level based on a second mapping. The circuitry identifies one or more parameters associated with each of the one or more components, and generates a query message. The query message is a function of either the one or more components or the one or more parameters. The circuitry transmits the query message to the vehicle, and receives the values of the one or more parameters from the vehicle. The circuitry validates the state of one or more components by matching the values of the one or more parameters to corresponding stored values of the one or more parameters.

20 Claims, 3 Drawing Sheets

(56) References Cited

U.S. PATENT DOCUMENTS

| | | | | |
|---|---|---|---|---|
| 2016/0179870 | A1* | 6/2016 | Johnson | G06F 1/3209 713/340 |
| 2016/0196132 | A1* | 7/2016 | Searle | H04L 41/082 717/173 |
| 2016/0294605 | A1* | 10/2016 | Searle | H04L 41/082 |
| 2016/0294614 | A1* | 10/2016 | Searle | G06F 8/654 |
| 2016/0350749 | A1* | 12/2016 | Wilkins | G06Q 20/382 |
| 2017/0005515 | A1* | 1/2017 | Sanders | H02J 3/381 |
| 2017/0249095 | A1* | 8/2017 | Ricci | H04W 4/21 |
| 2018/0130160 | A1* | 5/2018 | Alexander | G06Q 10/02 |
| 2018/0206208 | A1* | 7/2018 | Nguyen | H04W 72/005 |

* cited by examiner

METHOD AND SYSTEM FOR VALIDATING STATES OF COMPONENTS OF VEHICLE

CROSS-RELATED APPLICATIONS

This application claims priority of Indian Application Serial No. 201741045863, filed Dec. 20, 2017, the contents of which are incorporated herein by reference.

FIELD OF THE INVENTION

The present invention relates generally to vehicle monitoring systems, and more particularly, to a method and a system for validating states of various components of a vehicle in a transportation system.

BACKGROUND

Travel or transportation services, in particular on-demand cab services, generally balance the demands from customers and supply of vehicles for providing efficient services to the customers. With improvements in lifestyles of the customers and limited available alternatives of public or private transportation options, popularity of the cab services is continuously increasing. With increased demand for the cab services, various cab service-providers have come into the market to provide the cab services to the customers. The cabs are booked either on an individual basis or on a shared basis. On individual basis, a customer or small groups of customers traveling towards the same destination book a vehicle, whereas on shared basis, multiple customers share the vehicle to reach their respective destinations. Generally, the bookings of the vehicles are done using customer and driver devices, such as mobile phones running cab booking applications. The customer requests a service provider for a ride through the mobile application installed on the customer device. The service provider may transfer the request to an appropriate vehicle based on the availability and location of the vehicle. The driver of the vehicle accepts the received request through the mobile application installed on the driver device. The subsequent bookings of the vehicles are performed during an ongoing ride in case of shared rides. This results in presence of cabs on road throughout a day of service and for longer intervals of time.

Generally, vehicles in the transportation industry regularly travel long distances during rides, including passenger and commodity transport. This results in regular wear and tear of the components of the vehicle. If unnoticed, the regular wear and tear of the components may alter the states of the components from 'good' to 'damaged' or 'unusable'. The utilization of components in a damaged state for a ride may result in failure of a ride. Further, the components of the vehicle may be modified or replaced with sub-quality replacement components, generally when the vehicle is not under surveillance. This compromises the security of the passengers and the driver, while using the car. Vehicle fuel siphoning, modifying the engine oil by addition of external fluids, and replacing the critical components of the engine with sub-quality components, are some of the examples of such scenarios where the security of the passengers is compromised. Further, there is a possibility of scenarios, such as driver force-logging out from the mobile application in the middle of a ride, deviation of the vehicle from the route map suggested by the mobile application, and the like, where the security of a passenger of the vehicle may get compromised.

One known solution in the art for the above-mentioned problem is continuous monitoring for the presence of components using a vehicle command unit. The vehicle command unit is configured to continuously detect the presence of the components. Such systems are generally configured to run a diagnostic system to detect tampering of the components. One disadvantage of such systems is the lack of online real-time monitoring of the components. Further, such systems test each component of the vehicle. This increases the amount of data and time required to validate the states of components, as each component is to be diagnosed every time a diagnostic test is to be performed. This results in higher time to validate the component states, before allocating the vehicle to a customer. Further, the diagnostic system consumes higher power, as the system tests each component of the vehicle.

In light of the foregoing, there exists a need for a method and system for effective validation of the states of the components of a vehicle. The method and system should consume less time and power, compared to the existing solutions, for validating the states of the components. Further, the method and system should improve the security of a rider by tracking the status of the rider and the vehicle.

SUMMARY

In an embodiment of the present invention, a method for validating states of one or more components of a vehicle and a corresponding system are provided. The system comprises a circuitry to perform one or more operations. An event is received over a first communication network. A priority level of a set of priority levels is associated with the event based on a first mapping between events and priority levels. The priority level corresponding to the event is determined and the one or more components associated with the priority level are identified. The one or more components are associated with the priority level based on a second mapping between priority levels and components. The one or more parameters associated with each of the one or more components are identified. A query message is generated, which is a function of at least one of the one or more components or the one or more parameters. The query message is transmitted to the vehicle over the first communication network. Values of the one or more parameters are received by the circuitry over the first communication network. The circuitry validates the state of one or more components by matching the values of the one or more parameters to corresponding stored values of the one or more parameters.

In another embodiment of the present invention, a method for validating states of one or more components of a vehicle is provided. An event is identified by a device in communication with the one or more components of the vehicle. The event is transmitted over a first communication network to a remote server. Further, a priority level of a set of priority levels is associated with the event based on a first mapping between events and priority levels. The one or more components are associated with the priority level based on a second mapping between priority levels and components. One or more parameters are associated with each of the one or more components. A query message is received from the remote server over the first communication network. The query message is a function of at least one of the one or more components or the one or more parameters. The one or more identification units associated with the one or more parameters are determined and are queried by the device for values of the one or more parameters based on the received query message. Values of the one or more parameters are determined and transmitted by the one or more identification units over a second communication network to the device. The values of the one or more parameters are transmitted over the first communication network. The states of the one or more components are validated by the remote server by matching the values of the one or more parameters to stored values of the one or more parameters.

Various embodiments of the present invention provide a method and a system for validating states of one or more components of a vehicle. The system comprises circuitry to perform one or more operations and is configured to receive an event over a first communication network. The event corresponds to at least one of a modification in a state of the vehicle, an action performed by a driver of the vehicle, or an action performed by a passenger of the vehicle. Further, the event is associated with a priority level of a set of priority levels based on a first mapping between events and priority levels. The circuitry determines the priority level corresponding to the event. The priority level includes at least one of a critical, a high, a medium, or a low priority. The circuitry identifies the one or more components associated with the priority level, based on a second mapping between priority levels and components. The circuitry further identifies one or more parameters associated with each component. The one or more parameters correspond to physical parameters associated with the component. The circuitry then generates a query message that is a function of at least one of the one or more components or the one or more parameters. The circuitry transmits to the vehicle the query message over the first communication network. The circuitry receives values of the one or more parameters over the first communication network. The circuitry then validates the state of one or more components by matching the values of the one or more parameters to corresponding stored values of the one or more parameters. The circuitry generates first and second identification numbers based on the values of the one or more parameters, and the stored values of the one or more parameters, respectively. The circuitry compares the first identification number to the second identification number. The states of one or more components of the vehicle are validated when the first identification number matches the second identification number. The circuitry transmits at least one of an action command or one or more parameter check commands when the values of the one or more parameters do not match the corresponding stored values of the one or more parameters. The action command is associated with one or more actions such as immobilizing the vehicle, transmitting a notification to a driver of the vehicle, governing a speed of the vehicle, or changing states of the one or more parameters.

Thus, the system and method validate the one or more components based on a priority level of an event. Therefore, each component is validated at various time intervals based on the priority level thereof. All components of the vehicle are not validated together, thereby reducing the amount of time and power consumed for the validation.

BRIEF DESCRIPTION OF THE DRAWINGS

The accompanying drawings illustrate the various embodiments of systems, methods, and other aspects of the invention. It will be apparent to a person skilled in the art that the illustrated element boundaries (e.g., boxes, groups of boxes, or other shapes) in the figures represent one example of the boundaries. In some examples, one element may be designed as multiple elements, or multiple elements may be designed as one element. In some examples, an element shown as an internal component of one element may be implemented as an external component in another, and vice-versa.

Figure 1:
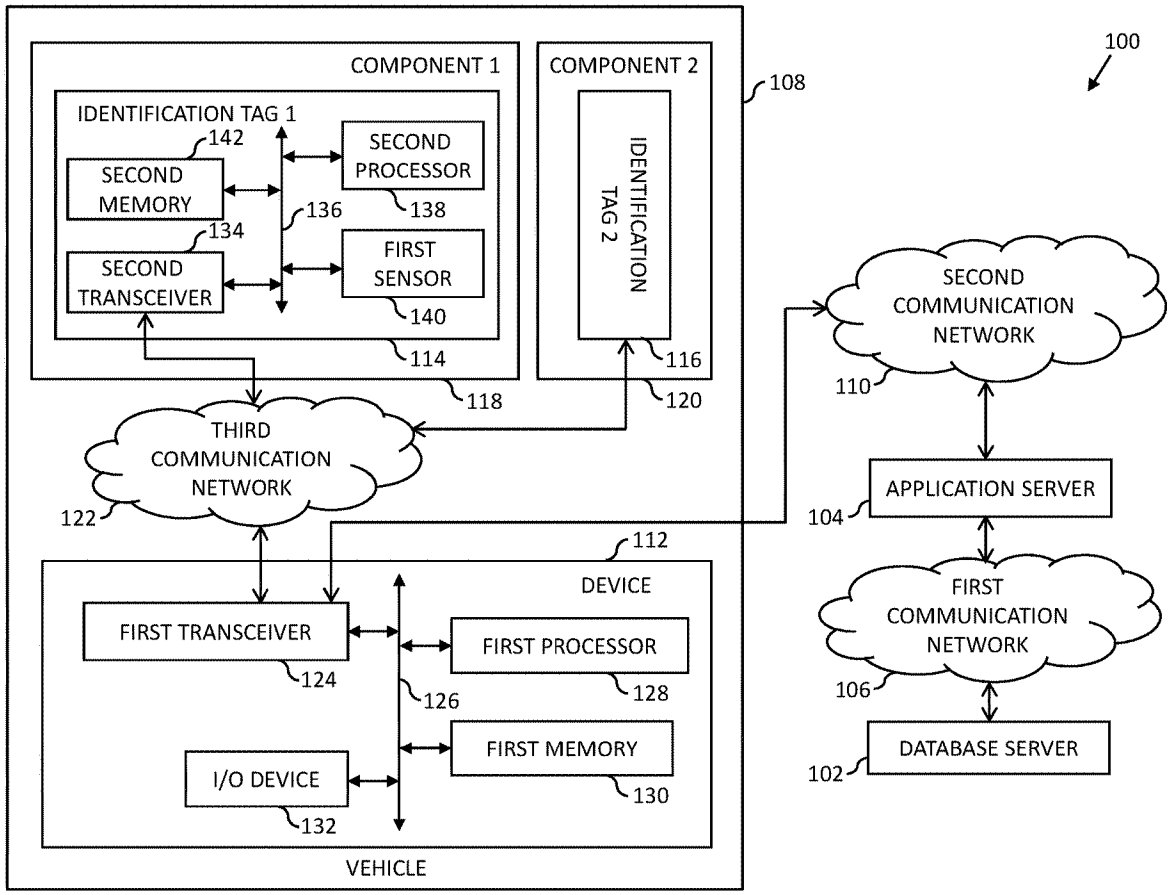
FIG. 1 is a block diagram that illustrates a system environment for validating states of one or more components of a vehicle in a transportation system, in accordance with an embodiment of the present invention.

Further areas of applicability of the present invention will become apparent from the detailed description provided hereinafter. It will be understood that the detailed description of exemplary embodiments is intended for illustration purposes only and is, therefore, not intended to necessarily limit the scope of the invention.

DETAILED DESCRIPTION

As used in the specification and claims, the singular forms "a", "an" and "the" include plural references unless the context clearly dictates otherwise. For example, the term "an article" may include a plurality of articles unless the context clearly dictates otherwise. Those with ordinary skill in the art will appreciate that the elements in the figures are illustrated for simplicity and clarity and are not necessarily drawn to scale. For example, the dimensions of some of the elements in the figures may be exaggerated, relative to other elements, in order to improve the understanding of the present invention. There may be additional components described in the foregoing application that are not depicted on one of the described drawings. In the event such a component is described, but not depicted in a drawing, the absence of such a drawing should not be considered as an omission of such design from the specification.

Before describing the present invention in detail, it should be observed that the present invention utilizes a combination of system components, which constitutes systems and methods for validating states of components of a vehicle in a transportation service. Accordingly, the components and the method steps have been represented, showing only specific details that are pertinent for an understanding of the present invention so as not to obscure the disclosure with details that will be readily apparent to those with ordinary skill in the art having the benefit of the description herein. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

References to "one embodiment", "an embodiment", "another embodiment", "yet another embodiment", "one example", "an example", "another example", "yet another example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment.

A transportation service is a service in which a vehicle is provided to a customer to transit between a plurality of locations including source and destination locations specified by the customer. The vehicle is a means of transport that is deployed by a transport provider to provide the transportation service, such as an on-demand cab service, to the customer. For example, the vehicle may be an automobile, a bus, a car, and the like. Hereinafter, various methods for validating states of components of a vehicle in the transportation service have been described that will become apparent to a person having ordinary skills in the relevant art.

Referring now to FIG. 1, a block diagram that illustrates a system environment 100 for validating states of one or more components of a vehicle in a transportation system is shown. The system environment 100 includes a database server 102 and an application server 104 (also referred to as a remote server or a server) that are connected to each other by way of a first communication network 106. Examples of the first communication network 106 include, but are not limited to, a wireless fidelity (Wi-Fi) network, a light fidelity (Li-Fi) network, a satellite network, the internet, a mobile network such as cellular data network, high speed packet access (HSPA), or any combination thereof. The system environment 100 further includes a vehicle 108 in communication with the application server 104 by way of a second communication network 110. The vehicle 108 includes a device 112, in communication with first and second identification tags 114 and 116 associated with first and second components 118 and 120 by way of a third communication network 122. The device 112 further communicates with the application server 104, by way of the second communication network 110. Examples of the second communication network 110 include, but are not limited to, a Wi-Fi network, a Li-Fi network, a satellite network, the internet, a mobile network such as cellular data network, and HSPA, or any combination thereof.

It will be understood by a person skilled in the art that the number of components of the vehicle 108, such as the first and the second components 118 and 120, and the corresponding identification tags associated with the components, such as the first and the second identification tags 114 and 116, respectively, are not limited to two, as illustrated in FIG. 1. The vehicle 108 may include more than two components and associated corresponding identification tags. Further, in an example, a component of the vehicle 108 may be associated with more than one identification tag. In one embodiment, each identification tag transmits at least one value of a parameter of the component. Further, each identification tag may include more than one sensor for measuring the parameters. In an exemplary embodiment, the system environment 100 may include a single communication network, such as the first or second communication network 106 and 110. In such a scenario, the database server 102, the device 112, and the first and second components may communicate with each other by way of the first or second communication network 106 and 110.

The database server 102 is a data management and storage server that includes a processor (not shown) and a memory (not shown) for managing and storing values of parameters associated with components of one or more vehicles of the transportation system. The values of the parameters of the vehicles may include measurements performed by various sensors in a vehicle. Further, the database server 102 stores the values of the determined parameters. The processor of the database server 102 receives and stores the values of parameters in the memory of the database server 102. In one embodiment, the database server 102 stores more than one unique identification number corresponding to the parameters of the vehicles. A unique identification number of a vehicle corresponds to a digital fingerprint of the vehicle. The database server 102 utilizes the unique identification numbers to identify corresponding parameters of the vehicles. The database server 102 further manages and stores driver information corresponding to the drivers. The driver information of a driver may include at least a name, a registered vehicle, or a driver account of the driver registered with the transportation service. The database server 102 may be realized through various web-based technologies such as, but not limited to, a Java web-framework, a .NET framework, a PHP framework, or any other web-application framework. Examples of the database server 102 include, but are not limited to, a personal computer, a laptop, or a network of computer systems.

An event may include one or more scenarios or attributes, such as driver on-duty, driver off-duty, allocation of booking to a transport requester, driver logout, driver blacklisted, driver going off-road, driver force logged out, driver login failure, or driver rash driving. The event may further include a driver and a passenger security based actions such as driver logging out in the middle of a ride, the deviation of the vehicle 108 from a suggested route map, and the like. The event may be generated based on driver actions, customer actions, driver location, and vehicle sensors. The events generated based on driver actions may include status of driver such as driver On-duty or Off duty, status of a ride such as booking complete or incomplete, attributes associated with the driver such as driver logout, driver blacklisted, driver going off road, driver force logged out, driver login failure, and rash driving. The events generated based on customer actions may include customer-reported rash driving, customer-reported low rating, customer-reported route diversion, and customer-reported wrong driver for pick up. The events generated based on driver location may include the vehicle 108 entering or exiting a workshop for repair and maintenance, the vehicle 108 entering or exiting a yard, and the vehicle 108 geo-location such as in proximity to a fraud zone. The events generated based on vehicle sensors may include generation of a diagnostic trouble code (DTC), status of the components of the vehicle 108 such as opening of a bonnet, disassembling a tire of the vehicle 108, and status of the engine such as running or fault detection.

A priority level is associated with each event. The priority levels include but are not limited to high, low, medium, and critical. The priority level that is associated with an event is based on a first mapping between the event and an associated priority level. In one example, the events driver logout, driver rash driving, deviation of the vehicle 108 from a suggested route map are mapped to the 'critical' priority level. The events such as allocations of booking to a transport requester, and driver login failure are mapped to the 'medium' priority level. Various other events may be mapped to a 'low' priority level.

Further, the event may also include a regular time interval based check-up of the components. When the component is to be monitored based on a fixed time-period basis (also referred to as designated time period), the event that includes a diagnostic message corresponding to a predetermined priority level is received from the application server 104. In one embodiment, the predetermined priority level is determined randomly. In another embodiment, the predetermined priority level is identified based on a predetermined sequence of priority levels. In one example, the predetermined priority level is identified based on a sequence such as the critical priority level, the high priority level, the medium priority level, and the low priority level in the order specified. In yet another embodiment, the predetermined priority level is identified based on historical data corresponding to the events received from the device 112. In one example, when a total number of validations corresponding to a particular priority level is lower, that priority level is identified as the predetermined priority level.

The application server 104 corresponds to a computing device 112, a software framework, or a combination thereof, that may provide a generalized approach to create the application server 104 implementation. In an embodiment, the operation of the application server 104 may be dedicated to execution of procedures, such as, but not limited to, programs, routines, or scripts stored in one or more memories for supporting its applied applications. The application server 104 stores one or more algorithms, mappings between events and priority levels, and mappings between the priority levels and the components. The application server 104 utilizes the algorithms to determine identification numbers based on values of either stored parameters or received parameters. In an embodiment, the application server 104 processes the values of the parameters to determine the corresponding identification numbers. In one embodiment, the identification numbers are generated using encryption algorithms such as hashing algorithms. In one example, the application server 104 generates a first identification number using encryption algorithm on the values of the stored parameters. The application server 104 then transmits the first identification number to the database server 102. The database server 102 stores the first identification number corresponding to a vehicle chassis number of the vehicle 108.

The application server 104 further receives the events from the vehicles. In one embodiment, the application server 104 receives an event from the vehicle 108. The events are generated based on modification in a state of the vehicle 108, an action performed by a driver of the vehicle 108, or an action performed by a passenger of the vehicle 108. The application server 104 determines a priority level based on a first mapping between the events and priority levels. The application server 104 generates a query message for determining the values of the parameters. In one embodiment, the application server 104 generates a second identification number using encryption algorithm on the values of the received parameters. The application server 104 then retrieves the first identification number corresponding to the vehicle 108 from the database server 102 and compares the first identification number with the second identification number to determine whether the values of the parameters are modified. When the second identification number matches the first identification number, the application server 104 validates the state of the components. Thus, the first identification number is unique to a vehicle and the corresponding values of the parameters. The first identification number functions as a digital fingerprint of the vehicle and a set of values of parameters associated with the vehicle. In another embodiment, the application server 104 receives and compares the values of the parameters to the stored values of the parameters retrieved from the database server 102. When the values of the received parameters match the stored values of the parameters, the application server 104 validates the state of the components.

The application server 104 generates an action command when a modification in values of the parameters is determined. The application server 104 generates an action command when the determined identification number does not match the retrieved identification number. In another embodiment, the application server 104 generates an action command when values of the received parameters do match the stored values of the parameters. The action command may include immobilizing the vehicle 108, transmitting a notification to the driver of the vehicle 108, governing the speed of the vehicle 108, changing states of the parameters, blacklisting of the driver, force logout of the driver from the mobile application, downgrading rating of the driver, or penalizing the driver. The application server 104 may be realized through various web-based technologies such as, but not limited to, a Java web-framework, a .NET framework, a PHP framework, or any other web-application framework. Examples of the application server 104 include, but are not limited to, a personal computer, a laptop, or a network of computer systems. The various operations of the application server 104 have been described in detail in conjunction with FIGS. 2 and 3.

The device 112 corresponds to a computing device that performs one or more activities, such as a mobile phone or a tablet. For example, the device 112 communicates with the identification tags associated with the components. In one embodiment, the device 112 is attached to the vehicle 108. The device 112 communicates with the sensors by way of the third communication network 122. In another embodiment, the device 112 may be within proximity of the sensors and may communicate with the sensors by way of the third communication network 122. In one example, the device 112 includes an application installed for communicating with the identification tags of the vehicle 108. The device 112 communicates with the first and second identification tags 114 and 116 of the vehicle 108 by way of the third communication network 122. In one embodiment, the device 112 transmits a 'determine' command to the first and second identification tags 114 and 116 for performing identification of the desired component. Further, the device 112 receives the real-time values of the parameters from the first and second identification tags 114 and 116.

Examples of the third communication network 122 include, but are not limited to, a wireless fidelity (Wi-Fi) network, a light fidelity (Li-Fi) network, a satellite network, the internet, a mobile network such as cellular data network, high speed packet access (HSPA), controlled area network (CAN), local interconnect network (LIN), media oriented systems transport (MOST), automotive Ethernet or any combination thereof. The device 112 receives an action command from the application server 104 and executes a set of steps for implementing a required change in the state of the vehicle 108 corresponding to the action command. In one example, the device 112 receives an action command corresponding to transmitting a notification to the driver of the vehicle 108. In one embodiment, the device 112 displays the notification to the driver. In another embodiment, the device transmits the notification to an application installed in a driver device (not shown). Examples of the device 112 include, but are not limited to, a personal computer, a laptop, a smartphone, a tablet computer, a personal digital assistant (PDA), a head unit, or any other portable communication device, that is placed inside or within proximity of the vehicle 108.

The components of the vehicle 108 correspond to various vehicle components that constitute the vehicle 108. For the sake of brevity, the first and second components 118 and 120 of the various vehicle components are disclosed. The present invention can be utilized in scenarios with more than two components without departing from the scope and the spirit of the present invention. The components of the vehicle 108 include, but are not limited to hood, vehicle chassis, bumper, cowl screen, deck lid, fascia rear and support, fender, front clip, ignition coil, air filter, and the like. Further, a priority level is associated with each component of the vehicle 108. The priority levels include but are not limited to high, low, medium, and critical. In one example, the hood, bumper, cowl screen, the deck lid, and the front clip of the vehicle 108 have a low priority level associated with them. The fascia and fender of the vehicle 108 have a medium priority level associated with them. The chassis, ignition coil, and the air filter of the vehicle 108 have a critical priority level associated with them. The fascia and fender of the vehicle 108 receive a request from a device 112 of the vehicle 108, when a 'medium' level priority event is detected. The fascia and fender transmit values of first and second parameters, respectively, to the device 112.

The identification tags are tags connected to the components of the vehicle 108 for determining either identity codes or values of the parameters. The first and second identification tags 114 and 116 determine and transmit first and second parameters of the first and second components 118 and 120 to the device 112 by way of the third communication network 122. In one example, the identification tags are Radio-frequency identification (RFID) tags. The RFID tags receive a query message from the device 112. The RFID tags measure values of the parameters associated with the components and transmit the values of the parameters to the device 112 by way of radio waves. The identification tags may store an identity code or include sensors to determine the values of the parameters. The identification code stores a unique code corresponding to the identification tag. In one example, an identification tag corresponding to a fender (not shown) stores a unique code. In one scenario, when the fender is missing or modified, the unique code received from the fender does not match with a unique code stored in the database server 102. When the identification tag includes a sensor, the sensor determines value of a parameter such as a physical parameter corresponding to the components with which the identification tag is associated. In one example, an identification tag connected to an engine (not shown) of the vehicle 108 includes a sensor for measuring the oil level and oil viscosity in the engine of the vehicle 108. Examples of such sensors include sensors that are part of the on-board diagnostic (OBD) systems, tire pressure monitoring systems (TPMS), engine coolant temperature sensor, and the like. The identification tag may transmit a DTC to the device 112 when corresponding component fails to be operational or is in a faulty condition.

An embodiment of present invention, or portions thereof, may be implemented as computer readable code on the application server 104. In one example, the application server 104 may be implemented using hardware, software, firmware, non-transitory computer readable media having instructions stored thereon, or a combination thereof and may be implemented in one or more computer systems or other processing systems. Hardware, software, or any combination thereof may embody modules and components used to implement the method of FIG. 2. An exemplary scenario of validating the first component 118 of the vehicle 108 is explained.

The first component 118 is connected to a first identification tag 114. The device 112 includes a first transceiver 124, a first communication infrastructure 126, a first processor 128, a first memory 130, and an input-output (I/O) device 132. The I/O device 132 corresponds to a device that receives an input from the driver or the passenger. The various modes of the input used by the driver or passenger may include, but are not limited to, a touch-based input, a text-based input, a voice-based input, a gesture-based input, or a combination thereof. The first identification tag 114 includes a second transceiver 134, a second communication infrastructure 136, a second processor 138, a first sensor 140, and a second memory 142. In one example, the first identification tag 114 stores a unique identification code. When the first identification tag 114 is modified, the unique identification code does not match with the corresponding unique identification code of the first identification tag 114 stored in the database server 102. In one scenario, on detection of an event corresponding to the priority level of the first component 118 the application server 104 determines the parameters associated with the first component 118. In one embodiment, when an event corresponding to the priority level of an engine is determined, the application server 104 determines temperature and oil viscosity as parameters associated with the engine based on the second mapping. The application server 104 then transmits a first query message to the device 112 by way of the third communication network 122 based on the determined parameters. In one example, the first query message is generated based on predetermined codes associated with the parameters. The second processor 138 determines the parameters associated with the first query message based on the codes included in the first query message. The first transceiver 124 of the device 112 receives the first query message by way of the third communication network 122. The first processor of the device 112 receives the first query message from the first transceiver 124 by way of the first communication infrastructure 126. In one example, the first query message is encrypted by way of an encryption algorithm. The first processor 128 receives and decrypts the first query to determine the components. The first processor 128 determines the parameters associated with the components.

In one example, the first query message corresponds to a first parameter of the first component 118. The first transceiver 124 transmits the first query message to the second transceiver 134. The first query message corresponds to the real-time value of the first parameter. The second transceiver 134 receives the first query message from the first transceiver 124 by way of the third communication network 122. The second processor 138 receives the first query message by way of the second communication infrastructure 136 and determines the first sensor 140 associated with the first query message. In one embodiment, the first query message can be associated with more than one sensor. The second processor 138 determines the corresponding sensors and generates corresponding determine commands. The second processor 138 transmits the determine command to the first sensor 140 for determining the real-time value of the first parameter. The first sensor 140 receives the determine command, determines the real-time value of the first parameter, and transmits the real-time value of the first parameter by way of the second communication infrastructure 136. The second processor 138 receives the real-time value of the first parameter and transmits the real-time value of the first parameter. The first processor 128 receives the real-time parameter by way of the first and second communication infrastructures 126 and 136, and the third communication network 122. The first processor 128 transmits the real-time value of the first parameter to the application server 104 by way of the second communication network 110.

Figure 2:
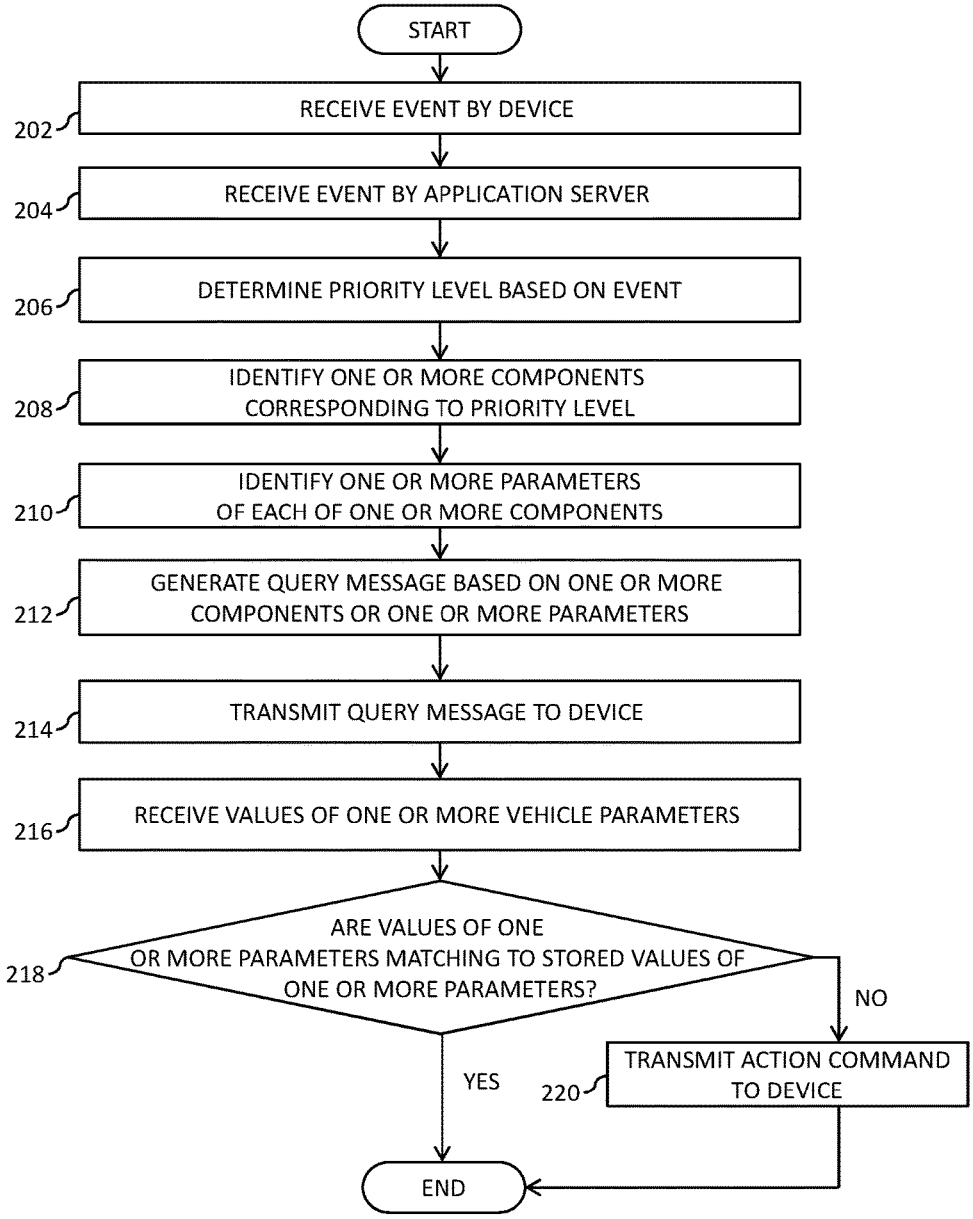
FIG. 2 is a flow chart that illustrates a method for validating states of one or more components of a vehicle, in accordance with an embodiment of the present invention.

Referring now to FIG. 2, a flow chart that illustrates a method for validating states of one or more components of a vehicle, in accordance with an embodiment of the present invention is shown. At step 202, the device 112 receives an event from at least one of the driver and passenger of the vehicle 108, by way of the I/O device 132. In another embodiment, the device 112 receives the first query message based on a pre-determined priority level at regular time intervals. In other words, it is checked whether the method of the present invention is not executed after a pre-determined time period has elapsed. In such a scenario, steps 216 and 218 are executed after the execution of step 202.

At step 204, the event of step 202 is received by the application server 104. The first processor 128 transmits the event to the application server 104 by way of the first transceiver 124 and second communication network 110. At step 206, a priority level corresponding to the event is determined by the application server 104. Further, the application server 104 receives the values of the parameters, the components associated with vehicle 108, and the first and second mappings corresponding to the vehicle 108 from the database server 102. In one embodiment, the application server 104 further receives a first identification number corresponding to the vehicle 108. In another embodiment, the application server 104 generates the first identification number based on the received stored values of the parameters. The application server 104 determines the priority level based on the first mapping between the events and the priority levels.

At step 208, the components corresponding to the priority level are identified. The application server 104 identifies the components corresponding to the determined priority level for validation based on the second mapping between the priority level and the components. At step 210, the application server 104 identifies the parameters corresponding to each component. At step 212, the application server 104 generates a query message based on the identified components or the parameters. In one embodiment, the application server 104 encrypts the query message. The application server 104 transmits the query message to the device 112 by way of the second communication network 110.

At step 214, the application server 104 transmits the query message to the device 112 by way of the second communication network 110. The device 112 receives the query message and determines and transmits the real-time values of the parameters. At step 216, the real-time values of the parameters are received by the application server 104. In one embodiment, the application server 104 generates a second identification number based on the real-time values of the parameters.

At step 218, the states of components are validated by matching real-time values of the parameters to corresponding stored values of the parameters. When the real-time parameters match the stored values of the parameters the application server 104 validates the components. When the real-time parameters do not match the stored values of the parameters the step 220 is executed. In one embodiment, the application server 104 matches the second identification number to the first identification number to determine the validity of the components.

At step 220, the application server 104 transmits an action command when the real-time parameters do not match the stored values of the parameters. The application server 104 determines a corresponding action command to be transmitted to the device 112. In one embodiment, when the vehicle location deviates from the preset route map from a suggested route map, the application server 104 transmits an immobilization command to the device 112 as action command. The device 112 receives the immobilization command and immobilizes the vehicle 108.

Figure 3:
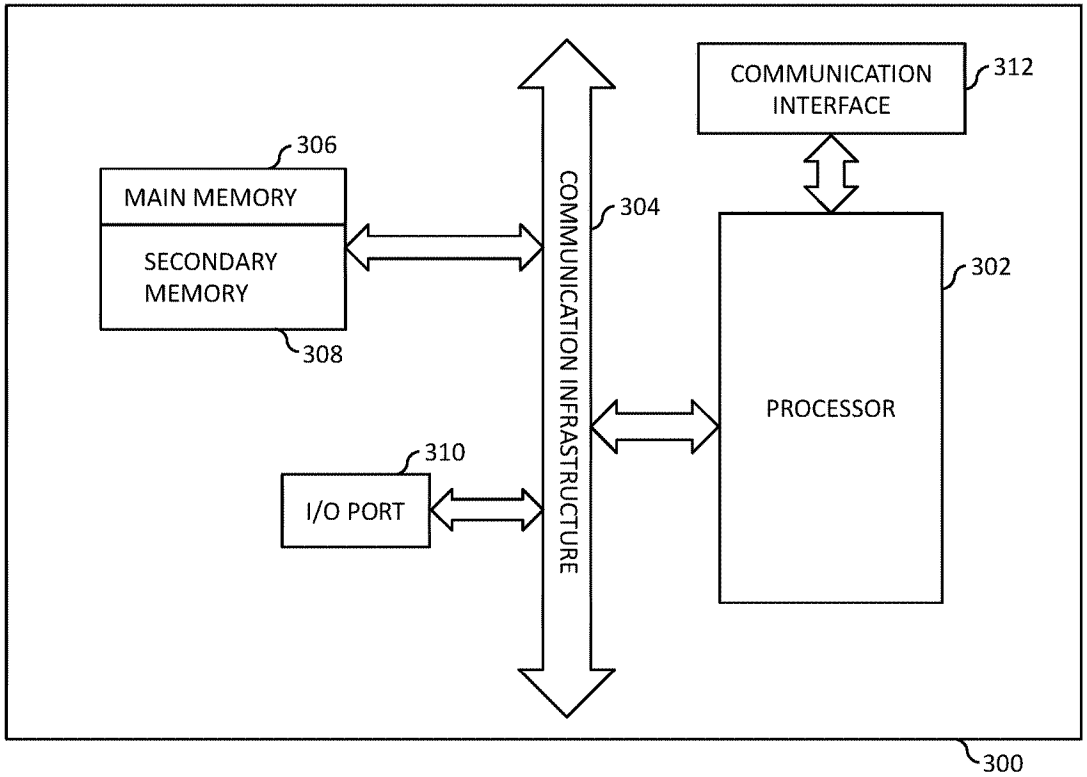
FIG. 3 is a block diagram that illustrates a computer system for validating states of one or more components of a vehicle, in accordance with an embodiment of the present invention.

Referring now to FIG. 3, a block diagram that illustrates a computer system 300 for validating states of one or more components of a vehicle, in accordance with an embodiment of the present invention is shown. An embodiment of the present invention, or portions thereof, may be implemented as computer readable code on the computer system 300. In one example, the application server 104 and the database server 102 of FIGS. 1 and 2 may be implemented in the computer system 300 using hardware, software, firmware, non-transitory computer readable media having instructions stored thereon, or a combination thereof and may be implemented in one or more computer systems or other processing systems. Hardware, software, or any combination thereof may embody modules and components used to implement the system and method of FIGS. 1 and 2 respectively.

The computer system 300 includes a processor 302 that may be a special-purpose or a general-purpose processing device. The processor 302 may be a single processor, multiple processors, or combinations thereof. The processor 302 may have one or more processor "cores." Further, the processor 302 may be connected to a communication infrastructure 304, such as a bus, a bridge, a message queue, the first, second, and third communication networks 106, 110, and 122, multi-core message-passing scheme, and the like. The computer system 300 further includes a main memory 306 and a secondary memory 308. Examples of the main memory 306 may include random access memory (RAM), read-only memory (ROM), and the like. The secondary memory 308 may include a hard disk drive or a removable storage drive (not shown), such as a floppy disk drive, a magnetic tape drive, a compact disc, an optical disk drive, a flash memory, and the like. Further, the removable storage drive may read from and/or write to a removable storage device in a manner known in the art. In an embodiment, the removable storage unit may be a non-transitory computer readable recording media.

The computer system 300 further includes an input/output (I/O) port 310 and a communication interface 312. The I/O port 310 includes various input and output devices that are configured to communicate with the processor 302. Examples of the input devices may include a keyboard, a mouse, a joystick, a touchscreen, a microphone, and the like. Examples of the output devices may include a display screen, a speaker, headphones, and the like. The communication interface 312 may be configured to allow data to be transferred between the computer system 300 and various devices that are communicatively coupled to the computer system 300. Examples of the communication interface 312 may include a modem, a network interface, i.e., an Ethernet card, a communications port, and the like. Data transferred via the communication interface 312 may be signals, such as electronic, electromagnetic, optical, or other signals as will be apparent to a person skilled in the art. The signals may travel via a communications channel, such as the first, second, and third communication networks 106, 110, and 122 which may be configured to transmit the signals to the various devices that are communicatively coupled to the computer system 300. Examples of the communication channel may include, but are not limited to, cable, fiber optics, a phone line, a cellular phone link, a radio frequency link, a wireless link, and the like.

Computer program medium and computer usable medium may refer to memories, such as the main memory 306 and the secondary memory 308, which may be a semiconductor memory such as dynamic RAMs. These computer program mediums may provide data that enables the computer system 300 to implement the methods illustrated in FIG. 2. In an embodiment, the present invention is implemented using a computer implemented application. The computer implemented application may be stored in a computer program product and loaded into the computer system 300 using the removable storage drive or the hard disc drive in the secondary memory 308, the I/O port 310, or the communication interface 312.

Specific advantages of the method and the system include validating the state of the first and second components 118 and 120 of the vehicle 108 based on a priority level of an event. Further, the deterioration of the first and second components 118 and 120 may be monitored. In one example, the reduction of air pressure in a tire based on the distance of ride and geographic location of the ride can be monitored. A select set of components based on priority level can be monitored in place of monitoring each of the components of the vehicle 108. Thereby an amount of power consumed by the device 112 and application server 104 can be reduced, thus improving the application cost of the validating the components of vehicle 108. Further, the amount of time required for determining the state of the vehicle 108 before allocation of the vehicle 108 to a passenger is reduced, since only the states of a select set of components of the vehicle 108 are validated before allocation. The states of remaining components not validated before the allocation are validated when an event corresponding to the components is generated. Therefore, the system and method of validating one or more components of a vehicle is efficient in comparison to the prior art.

A person having ordinary skills in the art will appreciate that embodiments of the disclosed subject matter can be practiced with various computer system configurations, including multi-core multiprocessor systems, minicomputers, mainframe computers, computers linked or clustered with distributed functions, as well as pervasive or miniature computers that may be embedded into virtually any device. For instance, at least one processor, such as the processor 402, and a memory, such as the main memory 406 and the secondary memory 408, implement the above described embodiments. Further, the operations may be described as a sequential process, however some of the operations may in fact be performed in parallel, concurrently, and/or in a distributed environment, and with program code stored locally or remotely for access by single or multiprocessor machines. In addition, in some embodiments, the order of operations may be rearranged without departing from the spirit of the disclosed subject matter.

Techniques consistent with the present invention provide, among other features, systems and methods for validating states of components of a vehicle in a transportation service. Unless stated otherwise, terms such as "first" and "second" are used to arbitrarily distinguish between the elements such terms describe. Thus, these terms are not necessarily intended to indicate temporal or other prioritization of such elements. While various exemplary embodiments of the disclosed system and method have been described above it will be understood that they have been presented for purposes of example only, not limitations. It is not exhaustive and does not limit the invention to the precise form disclosed. Modifications and variations are possible in light of the above teachings or may be acquired from practicing of the invention, without departing from the breadth or scope.

What is claimed is:

1. A method for validating states of one or more components of a vehicle, the method comprising:

receiving, by a server, an event over a first communication network, wherein a priority level of a set of priority levels is associated with the event, based on a first mapping between events and priority levels;

determining, by the server, the priority level corresponding to the event;

identifying, by the server, the one or more components associated with the priority level, wherein the one or more components are associated with the priority level based on a second mapping between priority levels and components;

identifying, by the server, one or more parameters associated with each of the one or more components;

generating, by the server, a query message, wherein the query message is a function of at least one of the one or more components or the one or more parameters;

transmitting to the vehicle, by the server, the query message over the first communication network;

receiving, by the server, values of the one or more parameters over the first communication network; and validating, by the server, the state of one or more components by matching the values of the one or more parameters to corresponding stored values of the one or more parameters.

2. The method of claim 1, further comprising transmitting, by the server, at least one of an action command or one or more parameter check commands when the values of the one or more parameters do not match the corresponding stored values of the one or more parameters.

3. The method of claim 2, wherein the action command is associated with one or more actions, and wherein the one or more actions include immobilizing the vehicle, transmitting a notification to a driver of the vehicle, governing a speed of the vehicle, or changing states of the one or more parameters.

4. The method of claim 1, further comprising generating, by the server, a first identification number based on the values of the one or more parameters.

5. The method of claim 4, further comprising generating, by the server, a second identification number based on the stored values of the one or more parameters.

6. The method of claim 5, further comprising comparing, by the server, the first identification number to the second identification number, wherein the states of one or more components of the vehicle are validated when the first identification number matches the second identification number, and wherein the server transmits at least one of an action command or one or more parameter check commands when the values of the one or more parameters do not match the corresponding stored values of the one or more parameters.

7. The method of claim 1, wherein the priority level includes at least one of a critical, a high, a medium, or a low priority.

8. The method of claim 1, wherein each parameter of the one or more parameters corresponds to a physical parameter associated with a component of the vehicle.

9. The method of claim 1, wherein the event corresponds to at least one of a modification in a state of the vehicle, an action performed by a driver of the vehicle, an action performed by a passenger of the vehicle, or exhaustion of a designated time period.

10. A method for validating states of one or more components of a vehicle, the method comprising:

identifying an event, by a device in communication with the one or more components of the vehicle;

transmitting, by the device to a remote server, the event over a first communication network, wherein a priority level of a set of priority levels is associated with the event based on a first mapping between events and priority levels, wherein the one or more components are associated with the priority level based on a second mapping between priority levels and components, and wherein one or more parameters are associated with each of the one or more components;

receiving, by the device from the remote server, a query message over the first communication network wherein the query message is a function of at least one of the one or more components or the one or more parameters;

determining, by the device, one or more identification units associated with the one or more parameters;

querying the one or more identification units for values of the one or more parameters based on the received query message, wherein values of the one or more parameters are determined and transmitted by the one or more identification units over a second communication network to the device; and transmitting, by the device, the values of the one or more parameters over the first communication network, wherein the states of the one or more components are validated by the remote server by matching the values of the one or more parameters to stored values of the one or more parameters.

11. The method of claim 10, further comprising receiving, by the device, at least one of an action command or one or more parameter check commands from the server when the one or more parameters do not match to the stored values of the one or more parameters, wherein the device executes an action associated with the action command.

12. The method of claim 11, further comprising executing at least one of an action and validate states of one or more components based on the action command and the one or more parameter check commands, respectively.

13. The method of claim 10, wherein the one or more identification units include one or more sensors for determining the one of more parameters.

14. A system of validating states of one or more components of a vehicle, the system comprising:

circuitry configured to:

receive an event over a first communication network, wherein a priority level of a set of priority levels is associated with the event based on a first mapping between events and priority levels;

determine the priority level corresponding to the event;

identify the one or more components associated with the priority level, wherein the one or more components are associated with the priority level based on a second mapping between priority levels and components;

identify one or more parameters associated with each of the one or more components;

generate a query message, wherein the query message is a function of at least one of the one or more components or the one or more parameters;

transmit to the vehicle the query message over the first communication network;

receive values of the one or more parameters over the first communication network; and validate the state of one or more components by matching the values of the one or more parameters to corresponding stored values of the one or more parameters.

15. The system of claim 14, wherein the circuitry is further configured to transmit at least one of an action command or one or more parameter check commands when the values of the one or more parameters do not match to the corresponding stored values of the one or more parameters.

16. The system of claim 15, wherein the action command is associated with one or more actions, and wherein the one or more actions include immobilizing the vehicle, transmitting a notification to a driver of the vehicle, governing a speed of the vehicle, or changing states of the one or more parameters.

17. The system of claim 14, wherein the circuitry is further configured to generate first and second identification numbers based on the values of the one or more parameters and the stored values of the one or more parameters, respectively.

18. The system of claim 17, wherein the circuitry is further configured to:

compare the first identification number to the second identification number for validation of the states of the one or more components, wherein the states of one or more components of the vehicle are validated when the first identification number matches the second identification number, and transmit at least one of an action command or one or more parameter check commands when the values of the one or more parameters do not match the corresponding stored values of the one or more parameters.

19. The system of claim 14, wherein the priority level includes at least one of a critical, a high, a medium, or a low priority.

20. The system of claim 14, wherein the event corresponds to at least one of a modification in a state of the vehicle, an action performed by a driver of the vehicle, an action performed by a passenger of the vehicle, or exhaustion of a designated time period.

* * * * *